United States Patent [19]

Ayers

[11] Patent Number: 4,869,191

[45] Date of Patent: Sep. 26, 1989

[54] FLOAT LAUNCH SYSTEM

[75] Inventor: Ray R. Ayers, Houston, Tex.

[73] Assignee: Shell Oil Company, Houston, Tex.

[21] Appl. No.: 516,156

[22] Filed: Jul. 21, 1983

[51] Int. Cl.[4] ..... B63B 21/56

[52] U.S. Cl. ..... 114/253; 114/242

[58] Field of Search ..... 181/118, 120, 115; 367/16, 20, 23; 441/21, 22, 23, 24, 25; 114/242, 243, 244, 245, 253, 254, 365, 366, 377, 378, 379, 380; 212/193; 244/1 TD

[56] References Cited

U.S. PATENT DOCUMENTS

| | | | |
|---|---|---|---|
| 2,103,708 | 12/1937 | Campbell | 114/365 |
| 3,045,635 | 7/1962 | Smith | 114/244 |
| 3,369,216 | 2/1968 | Loper | 367/16 |
| 3,494,443 | 2/1970 | Huffhines | 212/193 |
| 3,866,561 | 2/1975 | Sieber | 114/245 |
| 4,323,989 | 4/1982 | Huckabee et al. | 367/17 |

FOREIGN PATENT DOCUMENTS

| | | | |
|---|---|---|---|
| 1231486 | 5/1971 | United Kingdom | 114/244 |

*Primary Examiner*—Sherman D. Basinger
*Assistant Examiner*—Thomas J. Brahan

[57] ABSTRACT

A method and apparatus are provided for launching a towable body from onboard a towing ship while the towing ship is underway. Inasmuch as the towable body has a tendency to swing from side to side due to motion of the towing ship as the towable body is being lowered into the water, stabilizing apparatus which is attached to the towable body is lowered into the water first, the stabilizing apparatus tending to damp the side to side movement of the towable body.

1 Claim, 2 Drawing Sheets

FLOAT LAUNCH SYSTEM

BACKGROUND OF THE INVENTION

In some instances it is difficult to lower a towable body to the water while the towable body is alongside a "mother" ship (see FIG. 1). The main difficulty is with the effect of the motion of the mother ship on the towable body as the towable body is lowered to the water. The rocking motion of the mother ship is magnified in the motion of the towable body, switching from side to side at the end of booms and long cables. The motion of the towable body can become so extreme as to risk damage to itself and the mother ship, as well as workmen engaged in the operation.

One conventional way of stopping or at least limiting the swinging motion of the towable body is by attaching extra cables to the towable body which extend laterally to the mother ship in a restraining mode. However, this procedure may be somewhat unwieldy for launching a very heavy and cumbersome towable body, for example, a seismic subarray which may be up to 60 feet long, weigh up to 25,000 pounds, and have attached gear such as seismic guns and umbilical cables which are subject to entanglement. Accordingly, considering both the size and unwieldy dimensions of a seismic subarray, it is desirable to have a launch system which avoids the manifest problems of the art.

Applicant is not aware of any prior art references which, in his judgment as one skilled in the art of launching seismic subarrays, would anticipate or render obvious the novel launch method and apparatus of the instant invention.

SUMMARY OF THE INVENTION

The primary purpose of the present invention is to provide a launch system for lowering a towable body to the water from onboard a towing ship, which system is capable of handling a relatively cumbersome towable body, which may have attached gear subject to entanglement, and which system is orderly, relatively simple to use, and free of malfunctioning.

Accordingly, there is provided a method and apparatus for launching a towable body into the water alongside a towing ship which is underway, including the steps and means for performing the steps, of moving the towable body outboard of the ship, lowering stabilizing means attached to the towable body into the water beneath the towable body, whereby the stabilizing means damps the side to side movement of the towable body; and launching the towable body into the water. Preferably, the towable body is a seismic subarray and the stabilizing means is a seismic gun support beam. More preferably, the seismic subarray is released from a detachable saddle which is connected via cable(s) to boom(s) extending outboard of the ship. While the towed body is preferably a seismic subarray, it can also be a towed "fish", submarine or a smaller boat launched from alongside or from the stern of the mother ship.

Other purposes, advantages and features of the invention will be apparent to one skilled in the art upon review of the following.

DESCRIPTION OF PREFERRED EMBODIMENTS

Figure 1:
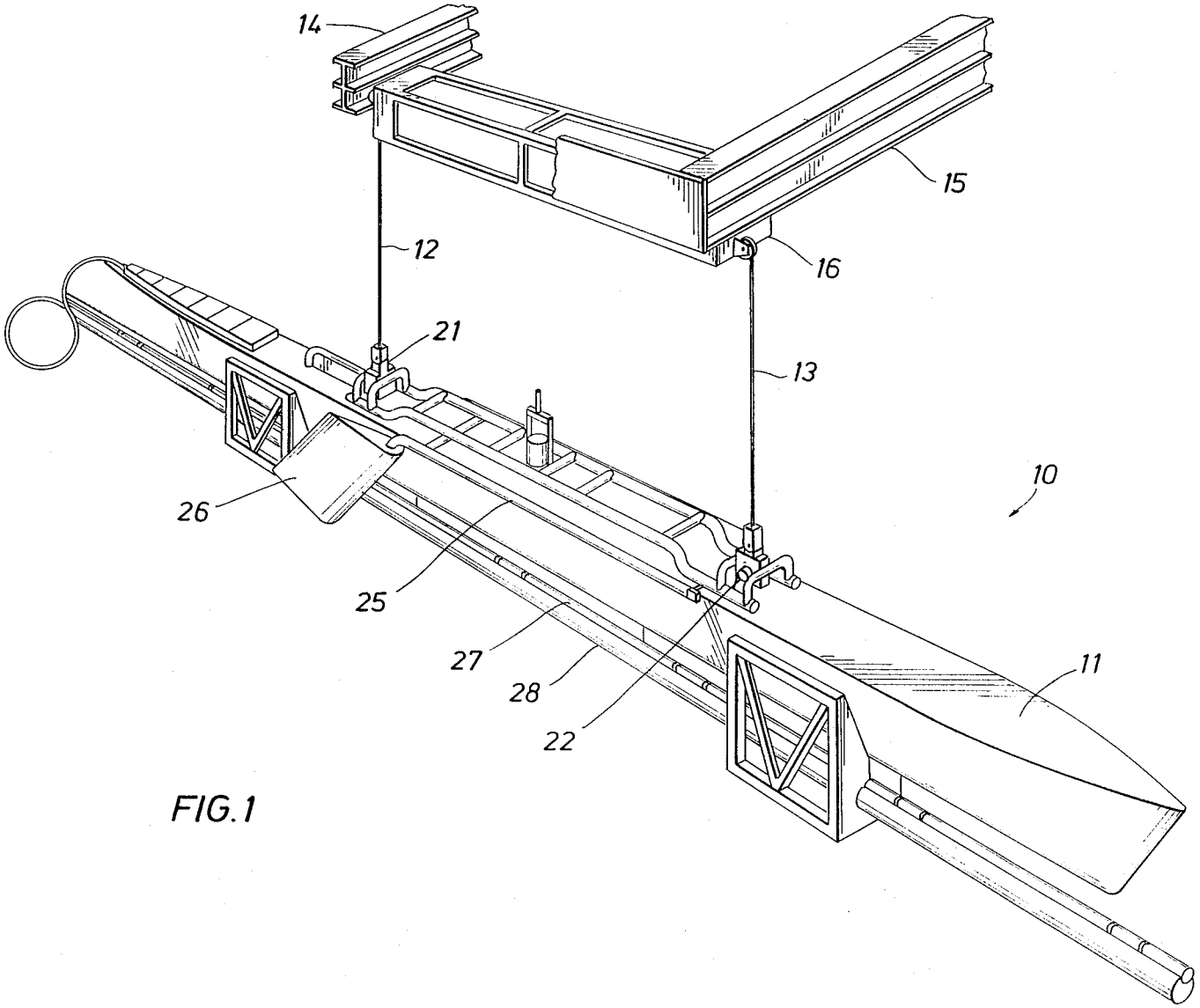
FIG. 1 discloses a seismic subarray onboard a vessel.

As shown in FIG. 1, a towing ship or "mother" ship 10 which is underway was a towable body 11 (such as a seismic subarray) which is suspendable outboard of the ship via cables 12 and 13 from overhead sliding rails 14 and 15 and travelling hoist 16. Towable body 11 may be a seismic subarray which is connected to ship 10 by umbilical cable (not shown) and outrigger support arm (not shown). Such a subarray may be quite long, e.g., up to 60 feet, and very heavy, e.g., 25,000 pounds. Launching such a subarray can be very difficult since the rocking motion of the mother ship is magnified in the motion of the towable body 11, swinging from side to side at the end of booms and long cables. It is not unusual for the motion of towable body 11 to become so extreme as to risk damage to itself, the mother ship and workmen performing the launching. Accordingly, the following described method and apparatus are directed to solving this problem.

Figure 2:
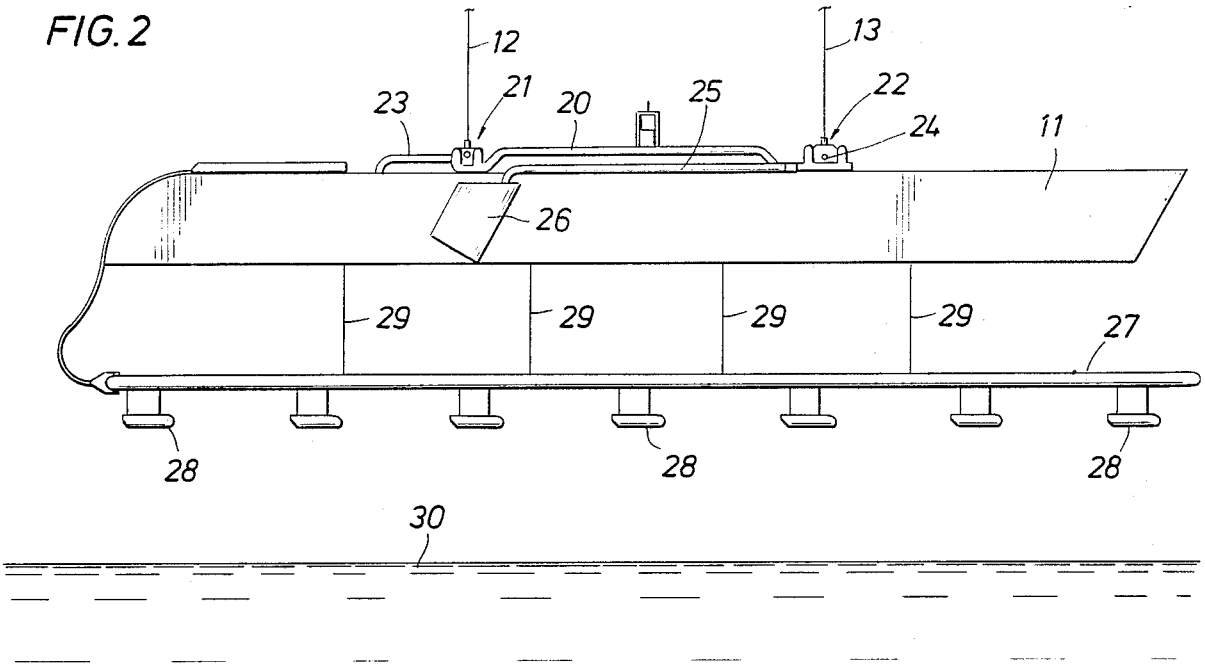
FIG. 2 discloses an initial step of the launch operation.
Figure 3:
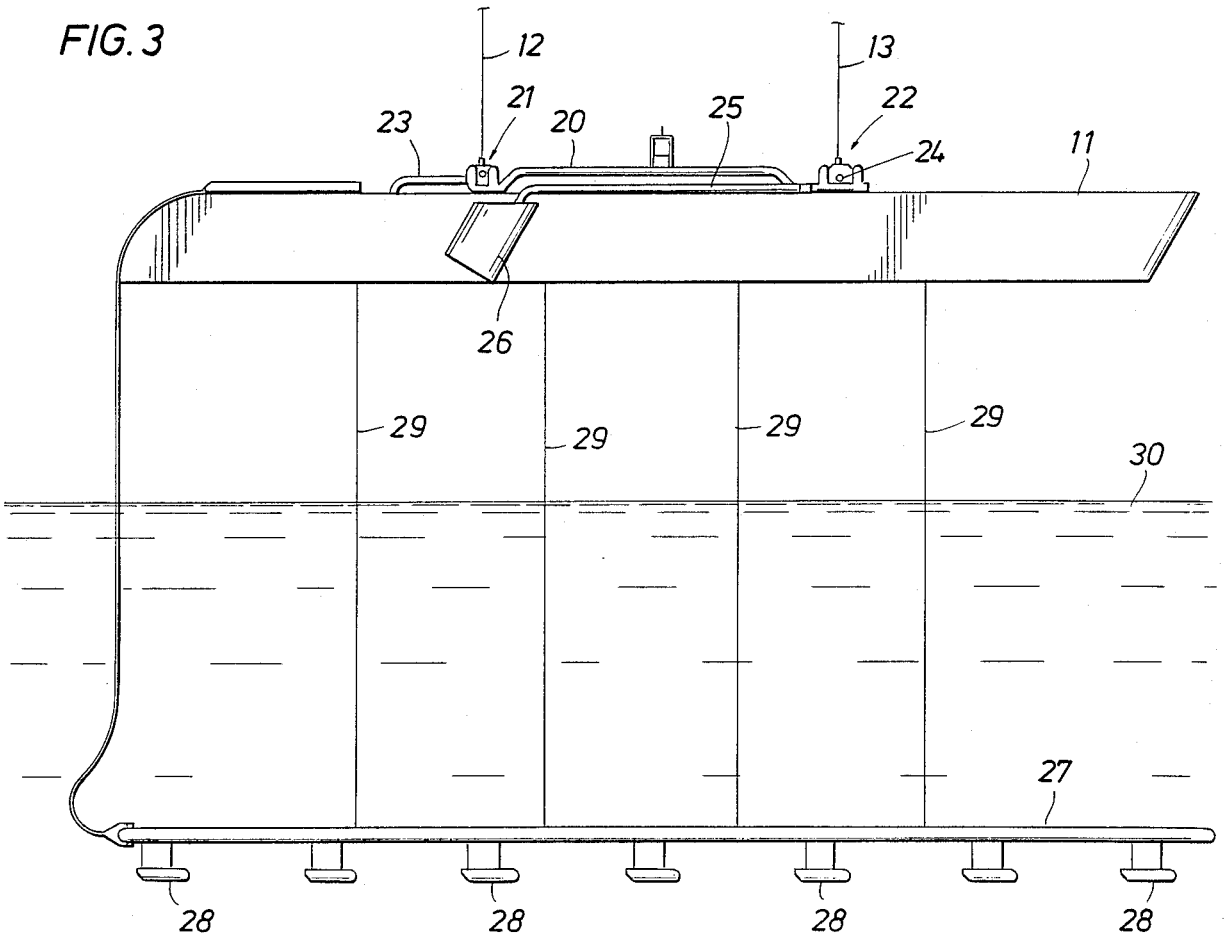
FIG. 3 provides a subsequent step of the launch operation.

A preferred apparatus for accomplishing this launch operation with a seismic array is shown in FIGS. 2 and 3. A spreader beam arrangement 20 that works like a detachable "saddle", is secured to float 11 with self-locking aft latch 21 and forward latch 22 and landing rail 23 and forward rail 24. Feeler arm 25 and rudder 26 are utilized in a lift operation described in appliant's copending application Ser. No. 516,155 filed 7/21/83. Beneath float 11 is seismic gun support beam 27 and guns 28 which are suspended by retractable cables 29.

As shown in FIG. 3, gun support beam 27 and guns 28 are first lowered from float 11 into water 30. This has an immediate effect of damping the motion of yet to be lowered float 11. In effect, once gun support beam 27 and guns 28 enter the water, they function as a stabilizing means for the rocking motions of float 11. The next step then is to lower float 11 to the water, thereby launching float 11 with a minimum of rocking motion by the float. Float 11 of course may be lowered closer to the water before dropping support beam 27 into the water. Likewise, support beam 27 may be drawn up closer to float 11 as float 11 is lowered, although preferably keeping support beam 27 in the water continuously as float 11 is lowered. In yet another mode of operation, support beam 27 can be lowered part way, and then float 11 and support beam 27 can be lowered the remaining distance simultaneously.

This method and apparatus can be utilized to launch other assemblies such as anchor buoy combinations.

The foregoing description of the invention is merely intended to be explanatory thereof. Various changes in the details of the described method and apparatus may be made within the scope of the appended claims without departing from the spirit of the invention.

What is claimed is:

1. A method for deploying a seismic subarray, which includes a float, seismic gun support beam and umbilical cable, from a vessel, comprising in combination the steps of:

putting the vessel underway;

connecting the subarray to the vessel by a detachable saddle rigged via a cable from a boom;

moving the subarray along the length of the boom outboard of the vessel;

deploying the seismic gun support beam from the float into the water, whereby the beam stabilizes the subarray;

lowering the float to the water;

releasing the detachable saddle from the float;

towing the released float with the vessel by the umbilical cable; and raising the detached saddle.

* * * * *